US009282769B2

(12) United States Patent
Mishra et al.

(10) Patent No.: US 9,282,769 B2
(45) Date of Patent: Mar. 15, 2016

(54) BIODEGRADABLE CIGAR TIP

(75) Inventors: Munmaya K. Mishra, Manakin Sabot, VA (US); William R. Sweeney, Richmond, VA (US); Chris Simpson, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 1023 days.

(21) Appl. No.: 13/421,155

(22) Filed: Mar. 15, 2012

(65) Prior Publication Data

US 2012/0305010 A1 Dec. 6, 2012

Related U.S. Application Data

(60) Provisional application No. 61/452,792, filed on Mar. 15, 2011.

(51) Int. Cl.

| | |
|---|---|
| ***A24F 7/00*** | (2006.01) |
| ***B05D 3/12*** | (2006.01) |
| ***B29C 45/00*** | (2006.01) |
| ***A24F 13/02*** | (2006.01) |

(52) U.S. Cl.
CPC .. *A24F 7/00* (2013.01); *A24F 13/02* (2013.01)

(58) Field of Classification Search
USPC ..... 131/175, 187, 219, 230, 227, 229; 264/239, 257, 299, 319, 328.1, 328.18, 264/330, 334; 427/299, 323–326
See application file for complete search history.

(56) References Cited

U.S. PATENT DOCUMENTS

| | | | |
|---|---|---|---|
| 216,160 | A | 6/1879 | Du Bois |
| 976,624 | A | 11/1910 | Benjaminowitsch |
| 1,507,925 | A | 1/1923 | Marshall, Jr. |
| 1,739,766 | A | 5/1927 | Morris |
| 1,830,446 | A | 11/1931 | Schunemann |
| 2,033,791 | A | 3/1936 | Sulzberger |

(Continued)

FOREIGN PATENT DOCUMENTS

| | | | |
|---|---|---|---|
| CN | 101803803 A | * | 8/2010 |
| CN | 101803803 B | * | 8/2012 |

(Continued)

OTHER PUBLICATIONS

Machine translation for CN 101803803 A, Google Patents, [online], retrieved from the Internet, [retrieved Feb. 25, 2015, <URL: http://www.google.ca/patents/CN101803803A?cl=en>.*

(Continued)

*Primary Examiner* — Dennis Cordray
(74) *Attorney, Agent, or Firm* — Buchanan, Ingersoll & Rooney PC

(57) ABSTRACT

A biodegradable cigar tip comprises an open upstream end configured to surround a downstream end of a cigar, the cigar tip having a mouth end optionally comprising a substantially flat cross-section, the cigar tip comprising a molded biodegradable material. The biodegradable material may consist of pressed cellulosic fibers with an outer surface of the cigar tip coated with a plastic film, wax coating or other waterproof coating such as a sugarcane pulp film. Alternatively, the biodegradable material may consist of an injection molded biodegradable resin such as a starch-filled resin wherein the starch-filled resin includes polypropylene or polyethylene and non-soluble starch selected from corn, tapioca, wheat, potato, plant sourced oligomer, or plant sourced polysaccharide or mixture thereof.

24 Claims, 2 Drawing Sheets

(56) References Cited

U.S. PATENT DOCUMENTS

| | | | | |
|---|---|---|---|---|
| 2,693,193 | A | | 11/1954 | Pelletier |
| 2,808,057 | A | | 10/1957 | Jaksch |
| 2,827,904 | A | | 3/1958 | Halstead |
| 2,956,569 | A | | 11/1960 | Desmond |
| 3,007,476 | A | | 11/1961 | Baugher et al. |
| 3,097,654 | A | | 7/1963 | Carlson |
| 3,113,575 | A | | 12/1963 | Creuziger |
| 3,204,643 | A | | 9/1965 | Redford |
| 3,256,372 | A | | 6/1966 | Adams et al. |
| 3,260,266 | A | | 7/1966 | Miller |
| 3,294,095 | A | | 12/1966 | Ackerman |
| 3,397,700 | A | | 8/1968 | Harlow et al. |
| 3,398,753 | A | | 8/1968 | Stelzer |
| 3,483,872 | A | | 12/1969 | Laporte |
| 3,520,307 | A | | 7/1970 | Fizet |
| 3,589,371 | A | | 6/1971 | Laporte |
| 3,646,944 | A | | 3/1972 | Banoczi |
| 3,688,985 | A | | 9/1972 | Engel |
| 3,834,285 | A | | 9/1974 | Schubert et al. |
| 3,951,155 | A | | 4/1976 | Prouse et al. |
| 4,003,386 | A | | 1/1977 | Bald et al. |
| 4,176,145 | A | * | 11/1979 | Guillet ..... 525/72 |
| 4,250,900 | A | | 2/1981 | Campbell et al. |
| 4,646,761 | A | | 3/1987 | Goldstein |
| 4,889,144 | A | | 12/1989 | Tateno et al. |
| 5,178,165 | A | | 1/1993 | DeFelice |
| 5,288,318 | A | | 2/1994 | Mayer et al. |
| 5,400,567 | A | | 3/1995 | Lindstrand |
| 5,444,113 | A | | 8/1995 | Sinclair et al. |
| 5,497,793 | A | | 3/1996 | Kubica |
| 5,660,900 | A | | 8/1997 | Andersen et al. |
| 5,913,311 | A | | 6/1999 | Ito et al. |
| 6,083,447 | A | | 7/2000 | Turner |
| 6,231,970 | B1 | | 5/2001 | Andersen et al. |
| 6,571,802 | B1 | | 6/2003 | Yamashita |
| 6,632,862 | B2 | | 10/2003 | Willett et al. |
| 6,739,344 | B2 | | 5/2004 | Yamashita |
| 7,071,249 | B2 | | 7/2006 | Ho et al. |
| 7,150,646 | B2 | | 12/2006 | Trumper |
| D588,741 | S | | 3/2009 | Murdaugh, III et al. |
| 7,767,283 | B2 | | 8/2010 | Forsberg et al. |
| 2006/0180163 | A1 | | 8/2006 | Thompson et al. |
| 2006/0191546 | A1 | | 8/2006 | Takano et al. |
| 2007/0043148 | A1 | | 2/2007 | Yi et al. |
| 2008/0276946 | A1 | | 11/2008 | Demond |
| 2009/0032037 | A1 | | 2/2009 | Xue et al. |
| 2009/0165808 | A1 | | 7/2009 | Melahropoulos |
| 2009/0288669 | A1 | | 11/2009 | Hutchens |
| 2010/0126505 | A1 | | 5/2010 | Rinker |

FOREIGN PATENT DOCUMENTS

| | | | |
|---|---|---|---|
| EP | 1163857 | A1 | 12/2001 |
| GB | 227912 | | 1/1925 |
| GB | 739259 | | 10/1955 |
| GB | 741416 | | 12/1955 |
| GB | 755479 | | 8/1956 |
| GB | 983209 | | 2/1965 |
| GB | 1013303 | | 12/1965 |
| GB | 1372377 | | 10/1974 |

OTHER PUBLICATIONS

Arutchelvi et al, "Biodegradation of polyethylene and polypropylene", Indian Journal of Biotechnology, vol. 7, pp. 9-22, 2008, [online], retrieved from the Internet, [retrieved Jun. 27, 2015], <URL: http://nopr.niscair.res.in/bitstream/123456789/7326/4/IJBT%207(1)%209-22.pdf>.*

Translation of CN 101803803, Google Patents, 2015, [online], retrieved Feb. 25, 2015, [retrieved from the Internet], <URL: http://www.google.ca/patents/CN101803803A?cl=en[2/25/2015 9:39:02 AM]http://www.google.ca/patents/CN101803803A?cl=en[2/25/2015 9:39:02 AM].*

International Search Report an Written Opinion dated Jun. 13, 2012 for PCT/US2012/029158.

* cited by examiner

FIG. 1
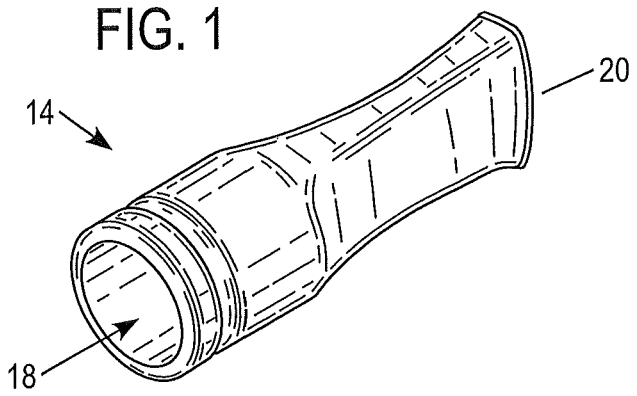
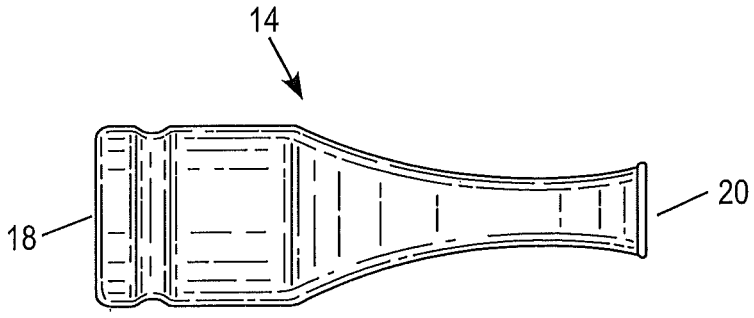
FIG. 2

BIODEGRADABLE CIGAR TIP

CROSS-REFERENCE TO RELATED APPLICATION

The application claims priority under 35 U.S.C. §119(e) to U.S. provisional Application No. 61/452,792 filed on Mar. 15, 2011, the entire content of which is incorporated herein by reference.

SUMMARY

In a preferred embodiment, a cigar tip is made of molded biodegradable material and comprises an open upstream end configured to surround a downstream end of a cigar and a mouth end optionally comprising a substantially flat cross-section. The molded biodegradable material can be pressed cellulosic fibers such as pressed cardboard or a biodegradable resin such as a starch-filled resin.

BRIEF DESCRIPTION OF THE DRAWINGS

FIG. 1 is a perspective view of a cigar tip.

FIG. 2 is a side view of the cigar tip of FIG. 1

DETAILED DESCRIPTION

Figure 3:
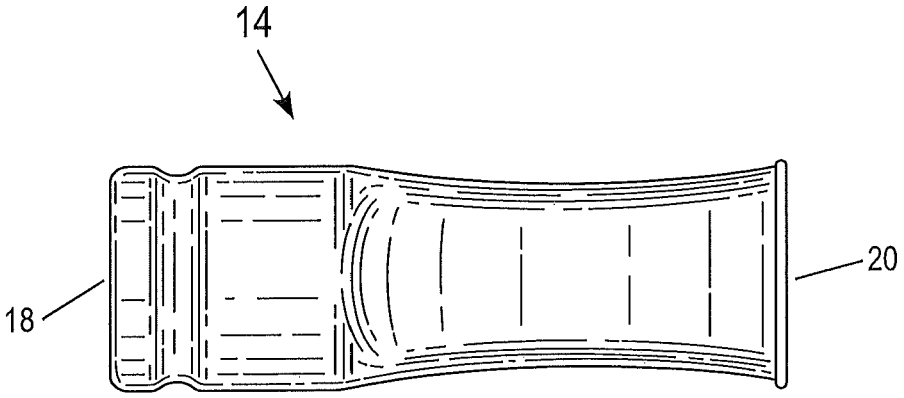
FIG. 3 is a top view of the cigar tip of FIG. 1.
Figure 4:
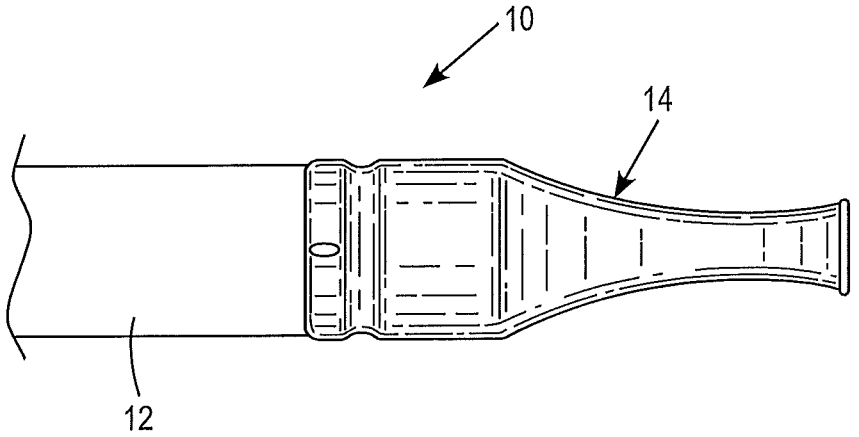
FIG. 4 is a side view of the cigar tip of FIG. 1 with a cigar attached thereto.

FIGS. 1-3 show an exemplary cigar tip 14 and FIG. 4 shows a tipped cigar 10, a tobacco section 12 and a cigar tip 14.

In a preferred embodiment, the cigar tip 14 has an open upstream end 18 and a mouth end 20. In the preferred embodiment, the cigar tip 14 is secured to the tobacco rod (or section) 12 of the cigar 10 and sold as a single product. The cigar tip 14 may be friction fitted with the tobacco section 12. Alternatively, an adhesive can be used to attach the cigar tip 14 to the tobacco section 12.

In another embodiment, the cigar tip 14 can be removable and/or reusable with other cigars. In this embodiment, the cigar tip 14 can be sold with one or more tobacco sections or as a separate accessory.

Moreover, the cigar tip 14 has a mouth end 20 comprising a generally flat cross-section. Also preferably, the upstream end 18 comprises a tube having a substantially uniform diameter that is slightly larger than the diameter of the cigar 10. However, the shape of the molded biodegradable cigar tip 14 is not limited to the shape shown in FIGS. 1-4.

In one embodiment, a biodegradable cigar tip 14 comprises an open upstream end 18 configured to surround a downstream end of a cigar 10. The cigar tip 14 has a mouth end 20 optionally comprising a substantially flat cross-section. The cigar tip 14 comprises a molded biodegradable material.

In a preferred embodiment, the cigar tip 14 is formed of a biodegradable material selected from the group consisting of pressed cellulosic material or injection molded biodegradable resin. The biodegradable material can be a press molded pulp slurry such as cardboard pulp or cellulose paper fibers or injection molded starch-filled resin. The molded cigar tip 14 can withstand saliva during use but will breakdown if left in the environment. If desired, the molded cigar tip 14 can incorporate a flavor or sweetener in the molded body or as a coating on an outer surface of the molded body. The injection molded starch-filled resin provides an acceptable mouth feel because of its more hydrophilic nature due to the presence of starch such as corn starch. A preferred starch-filled resin includes about 70 weight % polypropylene and about 30 weight % corn starch.

Resin Embodiment

The biodegradable material may consist of an injection molded starch-filled resin wherein the starch-filled resin may include an olefin, such as low density polyethylene, polypropylene or polyethylene and non-soluble starch selected from corn, tapioca, wheat, potato, plant sourced oligomer, or plant sourced polysaccharide or mixture thereof. For example, the starch-filled resin can comprise about 50 to 95 weight %, preferably about 70 weight % resin and about 5 to 50 weight % (i.e., about 5 to about 45 weight % or about 10 to about 35 weight %), preferably about 30 weight % starch. Another suitable biodegradable material is polylactic acid. In one embodiment, the resin can include organic additives which aid in degrading the resin when disposed. Suitable additives include Eco-One™ available from EcoLogic, LLC. For example, the cigar tip can include 99.5% to 50% resin, 0.5% to 50% organic additive. Optionally minor amounts of starch, tobacco, flavor and/or sweeteners can also be included along with the organic additive. If desired, flavorant can be incorporated in the biodegradable resin in which case the starch provides a means to retain and release hydrophilic flavors and aromas which are incompatible with the hydrophobic polymer. For example, the molded biodegradable material comprises resin and 20 to 40 weight % starch, resin and 20 to 40 weight % ground tobacco or resin and 20 to 40 weight % starch and ground tobacco.

The resin can be molded by melting the resin, introducing the melted resin in a mold and cooling this molded resin. Starch can be used as a filler in the resin and some or all of the starch can be replaced with tobacco.

Cellulosic Material Embodiment

The biodegradable material may consist of molded cellulosic fibers with an outer surface of the cigar tip 14 coated with a plastic film, wax coating or other biodegradable waterproof coating such as a film of sugarcane pulp.

The cigar tip 14 can be made by various techniques such as pressing, draining and drying a cellulosic pulp or mechanical press molding using a high level of pulp plus binder and optional finely ground tobacco. The process can include filling a mold cavity with a pulp slurry, compressing the slurry to form a molded cigar tip 14, and drying the molded cigar tip 14 without heating the molded cigar tip 14. The pulp slurry may contain about 50 to 90 weight %, preferably about 60 to about 70 weight % solids and about 10 to 50 weight %, preferably about 30 to 40 weight % water and the molded biodegradable material may include a flavor additive comprising liquid filled and/or solid microcapsules. If desired, the molded biodegradable material can include colorants and/or be coated with a flavored film and/or a water proof film. If cardboard is used, it is preferable to coat the molded cigar tip with a waterproof coating such as by laminating the cigar tip 14 with a plastic film, curtain coating (spraying) an exterior plastic coating, impregnating a wax coating, or cascading a hot wax on the cigar tip 14.

Various cellulosic materials/fibers may be used during pulping process which then can be used to fabricate cigar tips 14. The non-limiting examples of cellulosic materials/fibers may include the use of various natural/renewable resources such as bamboo, wood, certain grasses, rags, sugar-cane, corn stalks/leaves, tobacco plant materials including stalks/stems, coconut, palm, recyclable cellulosic materials such as newsprints, office papers, cardboard, fabrics, etc. Wood is the principal source of cellulosic fiber for pulp and paper manufacture. At present, wood provides about 95% of the world's virgin fiber requirement, while non-wood sources, mainly bagasse, cereal straws, and bamboo provide the remainder.

In addition to cellulosic/fiber materials the pulping formulation may contain additional natural/synthetic polymers, gums, biopolymers, resins, etc. The formulation may also include various coloring agents, flavor/aroma compounds, encapsulated flavors, sweeteners, salt, humectants, coatings, various cations, and other additives, etc. to impart other desirable properties. The pulp may be washed, refined, cleaned and sometimes bleached further. In an embodiment, finely divided tobacco can be act as a flavor compound, which provides tobacco flavor to the smoker.

Various processes including extrusion may be employed to convert pulp into a moldable product such as cigar or cigarette tips 14. There are many new processes recently developed such as pulp extrusion at ultra-high consistencies (20% to 40% solids) developed at USDA Forest Service, Forest Products Laboratory (FPL) to convert recovered papers, wastepaper, and paper mill residuals into solid sheets or profiles for compression molding. This process requires adding a water-soluble polymer (WSP—such as natural and modified gums, cellulose derivatives, sodium carboxy-methylcellulose and hydroxypropyl-methylcellulose or blends thereof, and gelatin, etc.) to alter the rheological properties of the pulp and generate a paste that can be extruded. The variety of fibrous raw materials can have a significant impact on the efficiency of a WSP to alter viscosity, Therefore, an appropriate WSP must be selected that will rapidly hydrate and adhere to fiber surfaces, allowing flocs to disperse in the shear-intensive environment of an extruder.

The waterproof coating can also be made from the pulp of sugar cane. To make the coating biodegradable, cellulose is removed from the sugar cane by putting sugar cane through a fermentation process that preserves the lignin which is the waterproof part of cellulose.

The molded biodegradable material preferably comprises (i) cellulosic fibers of wood, bamboo, microcrystalline cellulose, paper, cardboard (paperboard) and/or tobacco or (ii) a biodegradable resin or starch-filled resin.

In an embodiment, the pulp comprises cellulose pulp plus about 5 to about 10 weight % finely ground tobacco having a particle size of about 20 to about 100 microns or larger, preferably about 35 microns. In another embodiment, tobacco powder having a particle size of about 20 to about 100 microns or larger, preferably about 35 microns, can be added to the pulp slurry in an amount ranging from about 0.01% to about 5% by weight (e.g., about 0.01% to about 4% by weight or about 1% to about 3% by weight).

In the preferred embodiment, the tobacco section 12 of the tipped cigar 10 includes tobacco cut filler. Preferably, the tobacco cut filler including types of tobacco such as Virginia, Burley, Oriental and semi-Oriental varieties. The tobacco cut filler may include a blend of two or more different types of tobacco. For example, the tobacco cut filler may include a blend of two or more of the above-mentioned different types of tobacco, such as an American blend. Alternatively, the tobacco cut filler may include a single one of the above-mentioned types of tobacco. Moreover, the tobacco cut filler may include tobaccos that are, for example, air, sun or flue-cured. Alternatively or in addition, the tobacco cut filler may have undergone treatment to, for example, reduce tobacco-specific nitrosamines (TSNA).

Besides tobacco leaf, the tobacco cut filler may include other ingredients typically found in tobacco cut filler such as, for example, expanded tobacco, homogenized tobacco (for example reconstituted tobacco, cast tobacco or extruded tobacco), tobacco stem (for example expanded or improved stem), tobacco fines and combinations thereof. Flavors and casings including one or more humectants, flavorants, sugars or combinations thereof may also be applied to the tobacco cut filler in a known manner.

Preferably, the tobacco cut filler is cut with a cut width of between about 0.4 mm and about 2.0 mm, more preferably with a cut width of between about 0.5 mm and about 0.8 mm. Alternatively, the tobacco cut filler can include portions of tobacco leaves and/or whole leaves rolled into a tube and circumscribed by an inner binder, which underlies a wrapper.

Preferably, the tobacco section 12 of the cigar 10 has a length ranging from about 125 mm to about 203 mm. The cigar 10 has a diameter ranging from about 12 mm to about 25 mm.

In this specification, the word "about" is used in connection with numerical values to indicate that mathematical precision of such values is not intended. Accordingly, it is intended that where "about" is used with a numerical value, a tolerance of ±10% is contemplated for that numerical value.

In this specification the words "generally" and "substantially" are sometimes used. When used with geometric terms, the words "generally" and "substantially" are intended to encompass not only features which meet the strict definitions but also features which fairly approximate the strict definitions.

While the foregoing describes in detail a preferred tipped cigar including a tobacco section and a cigar tip and methods of making the cigar with reference to a specific embodiment thereof, it will be apparent to one skilled in the art that various changes and modifications may be made to the cigar and equivalent methods may be employed, which do not materially depart from the spirit and scope of the foregoing description. Accordingly, all such changes, modifications, and equivalents that fall within the spirit and scope of the appended claims are intended to be encompassed thereby.

We claim:

1. A biodegradable cigar tip comprising:

an open upstream end configured to surround a downstream end of a cigar, the cigar tip having a mouth end optionally comprising a substantially flat cross-section, the cigar tip comprising a molded biodegradable material comprising (a) paperboard pulp and balance about 5 to about 10 weight % ground tobacco having a particle size of about 20 to about 100 microns, (b) paperboard pulp and balance about 0.01 weight % to about 5 weight % ground tobacco having a particle size of about 20 to about 100 microns, or (c) a starch-filled resin comprising about 50 weight % to about 99.5 weight % resin and about 0.5 weight % to about 50 weight % organic additive.

2. The cigar tip of claim 1, wherein the molded biodegradable material includes a flavor additive comprising liquid filled and/or solid microcapsules.

3. The cigar tip of claim 1, wherein the molded biodegradable material is coated with a flavored and/or biodegradable waterproof film.

4. The cigar tip of claim 1, wherein the molded biodegradable material comprises about 60 to about 80 weight % resin and about 20 to about 40 weight % starch.

5. The cigar tip of claim 1, wherein the molded biodegradable material comprises paperboard pulp and balance about 5 to about 10 weight % ground tobacco having a particle size of about 20 to about 100 microns.

6. A method of manufacturing the cigar tip of claim 1, comprising forming a paste of about 20 to about 40 weight % water and about 60 to about 80 weight % cellulosic fibers and optional binder, flavoring, sweetening and/or coloring agents, compressing the paste in a mold to form a molded cigar tip, ejecting the molded cigar tip and drying the molded cigar tip under ambient conditions.

7. The method of claim 6, wherein the paste comprises paperboard pulp and the molded cigar tip is brown in color.

8. The method of claim 6, further comprising polishing the molded cigar tip and/or coating the molded cigar tip with a waterproof coating.

9. A method of manufacturing the cigar tip of claim 1, comprising heating a mixture of resin, ground tobacco and optionally starch to melt the mixture, injecting the melted mixture into a mold cavity, allowing the mixture to solidify and ejecting the cigar tip from the mold.

10. The method of claim 6, wherein the cellulosic fibers comprise paperboard pulp and about 5 to about 10 weight % ground tobacco having a particle size of about 20 to about 100 microns.

11. The method of claim 6, wherein the cellulosic fibers comprise paperboard pulp and about 5 to about 10 weight % ground tobacco having a particle size of about 35 to about 100 microns.

12. The cigar tip of claim 1, wherein the molded biodegradable material comprises paperboard pulp and balance about 0.01 weight % to about 5 weight % ground tobacco having a particle size of about 20 to about 100 microns.

13. The cigar tip of claim 1, wherein the molded biodegradable material comprises about 50 weight % to about 99.5 weight % resin and about 0.5 weight % to about 50 weight % organic additive.

14. A biodegradable cigar tip comprising:

an open upstream end configured to surround a downstream end of a cigar, the cigar tip having a mouth end optionally comprising a substantially flat cross-section, the cigar tip comprising a molded biodegradable material, wherein the biodegradable material consists of pressed cardboard pulp.

15. The cigar tip of claim 14, wherein an outer surface of the cigar tip is coated with a plastic film, wax coating or sugarcane pulp coating.

16. The cigar tip of claim 14, made by filling a mold cavity with a pulp slurry, compressing the slurry to form a molded cigar tip, and drying the molded tip without heating the molded tip.

17. The cigar tip of claim 16, wherein pulp slurry contains about 60 to about 70 weight % solids and remainder water.

18. A biodegradable cigar tip comprising:

an open upstream end configured to surround a downstream end of a cigar, the cigar tip having a mouth end optionally comprising a substantially flat cross-section, the cigar tip comprising a molded biodegradable material, wherein the biodegradable material consists of injection molded starch-filled resin.

19. The cigar tip of claim 18, wherein the starch-filled resin includes polypropylene or polyethylene and non-soluble starch selected from corn, tapioca, wheat, potato, plant sourced oligomer, or plant sourced polysaccharide or mixture thereof.

20. The cigar tip of claim 19, wherein the starch-filled resin comprises about 70 weight % resin and about 30 weight % starch.

21. The cigar tip of claim 19, wherein the starch-filled resin comprises about 50 to about 95 weight % resin and about 5 to about 45 weight % starch.

22. The cigar tip of claim 18, wherein the starch-filled resin includes at least one olefin and non-soluble starch selected from corn, tapioca, wheat, potato, plant sourced oligomer, or plant sourced polysaccharide or mixture thereof.

23. A biodegradable cigar tip comprising:

an open upstream end configured to surround a downstream end of a cigar, the cigar tip having a mouth end optionally comprising a substantially flat cross-section, the cigar tip comprising a molded biodegradable material, wherein the molded biodegradable material comprises a biodegradable resin and 20 to 40 weight % starch, a biodegradable resin and 20 to 40 weight % ground tobacco, or a biodegradable resin and 20 to 40 weight % starch and ground tobacco.

24. A method of manufacturing a biodegradable cigar tip comprising an open upstream end configured to surround a downstream end of a cigar, the cigar tip having a mouth end optionally comprising a substantially flat cross-section, the cigar tip comprising a molded biodegradable material, the method comprising heating a mixture of a biodegradable resin and starch to a temperature above 100° C. to melt the mixture, injecting the melted mixture into a mold cavity, allowing the mixture to solidify and ejecting the cigar tip from the mold.

* * * * *